United States Patent [19]

Vaught

[11] 4,441,583

[45] Apr. 10, 1984

[54] GRATING CABLE HANGER

[76] Inventor: Ronald R. Vaught, 206 E. Pine, Bloomfield, N. Mex. 87413

[21] Appl. No.: 479,539

[22] Filed: Mar. 28, 1983

[51] Int. Cl.[3] ..... E04G 3/14

[52] U.S. Cl. ..... 182/150; 182/222; 211/113; 248/215; 248/340

[58] Field of Search ..... 182/150, 142, 222, 223; 248/340, 215; 211/113

[56] References Cited

U.S. PATENT DOCUMENTS

| | | | |
|---|---|---|---|
| 230,701 | 8/1880 | Haviland | 248/215 |
| 789,174 | 5/1905 | Seeley | 182/150 |
| 2,057,092 | 10/1936 | Geib | 182/150 |
| 2,070,334 | 2/1937 | Garber | 182/150 |
| 2,149,821 | 3/1939 | Sutherland | 211/113 |
| 3,021,919 | 2/1962 | Peters | 182/150 |
| 3,638,890 | 2/1972 | Burrell | 248/340 |
| 3,735,951 | 5/1973 | Reed | 182/150 |
| 3,998,332 | 12/1976 | Lambertson | 248/215 |
| 4,276,959 | 7/1981 | Barber | 182/150 |

*Primary Examiner*—R. P. Machado

*Attorney, Agent, or Firm*—Sughrue, Mion, Zinn, Macpeak and Seas

[57] ABSTRACT

A cable hanger bracket is provided for hanging a swinging scaffold from a walkway grating comprising vertical parallel side walls, a connected bottom wall and U-type oppositely extending bends for overlapping the grating of a steel grating walkway. A softener member device is secured between the parallel side walls and the connecting bottom wall and is designed to prevent cutting or chafing of a loop of cable about the softener member and between the parallel side walls. The cable hanger has U-bends and downwardly extending walls which overlap the grating and bind thereto in the event of overloading of a platform supported by cables and the hanger bracket.

10 Claims, 4 Drawing Figures

GRATING CABLE HANGER

BACKGROUND OF THE INVENTION

1. Field of the Invention

This device is to permit hanging a swinging stage scaffold under a steel walkway grating.

2. Statement of the Prior Art

The prior art shows scaffold hanging devices for wood beams and are not suitably strong enough for the environment wherein the present invention is used. Other prior art patents show use of a hanger clip for attachment to a "Z" beam which is of light weight sheet metal having a diagonal notch therein. This is a weak device could not be used as a cable hanger for the environment wherein the present invention is used. Other prior art patents show scaffolds attached to "I" beams. These devices could not be used on steel grating.

SUMMARY OF THE INVENTION

This invention concerns a grating cable hanger to support a swinging scaffold below a steel walkway and is constructed from heavy gauge steel to meet certain safety standards.

An object of this invention is to construct a cable hanger as a single unit by mass production and inexpensively.

Another object of this invention is to construct a unitary or single piece cable hanger having opposed parallel side walls and opposed oppositely turned U-type support bends for overlapping steel grating in such fashion as to prevent tripping of persons walking on said grating while the scaffold is supported therefrom.

Yet another object or feature of this invention is to provide a cable softener of semi-circular shape for attachment between the parallel walls of the cable hanger. Said softener for preventing cutting or chaffing of the cable which is looped between the parallel walls and rests on the softener device. The opposite ends of the cables, attached to the cable hangers, support a platform for supporting workers and heavy equipment.

Still another object of the invention is to provide the U-type bends having parallel depending walls of such length that binding will occur on the grating thus providing a safety feature in the event of overloading of scaffold platform.

These and other objects of this invention will become apparent from a reading of the specification when taken in light of the annexed drawings.

DESCRIPTION OF THE PREFERRED EMBODIMENT OF THE INVENTION

Figure 1:
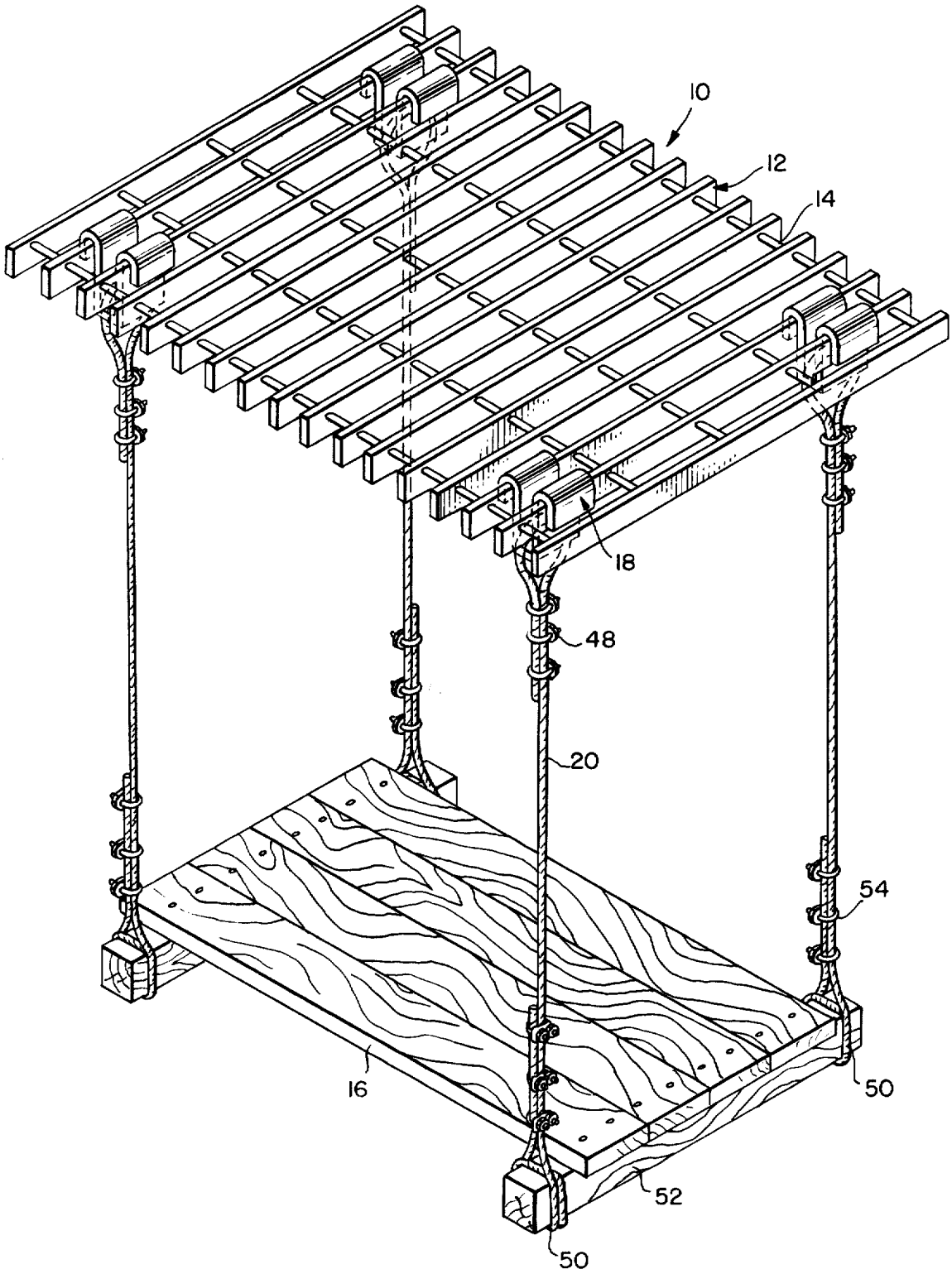
FIG. 1 is a perspective view of the cable hangers attached to steel grating and a swing type scaffold supported on the hangers by cables.

In FIG. 1 there is shown a steel walkway 10 having a number of steel gratings 12 used as a walkway for people. The gratings have cross members 14 to provide connections and reinforcements for the numerous steel gratings.

A platform 16 for supporting workers and heavy equipment is shown secured to the cable hangers 18 by cables 20.

Figure 2:
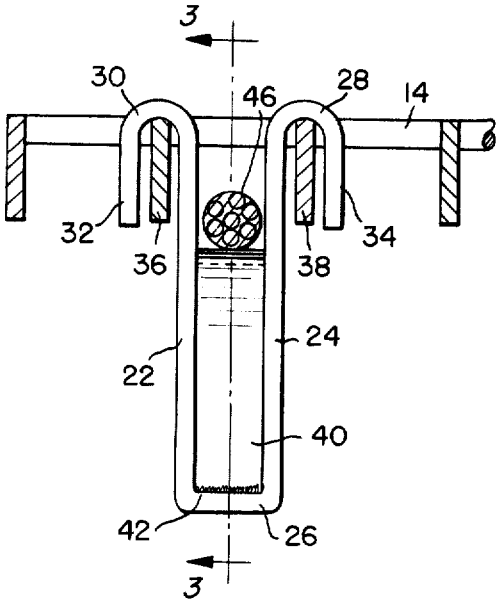
FIG. 2 is an end view of a cable hanger wherein the U-bends are supported on said grating, a semi-circular softener member welded between the parallel walls of the hanger and a cable looped between the hanger walls and resting on the softener device.
Figure 3:
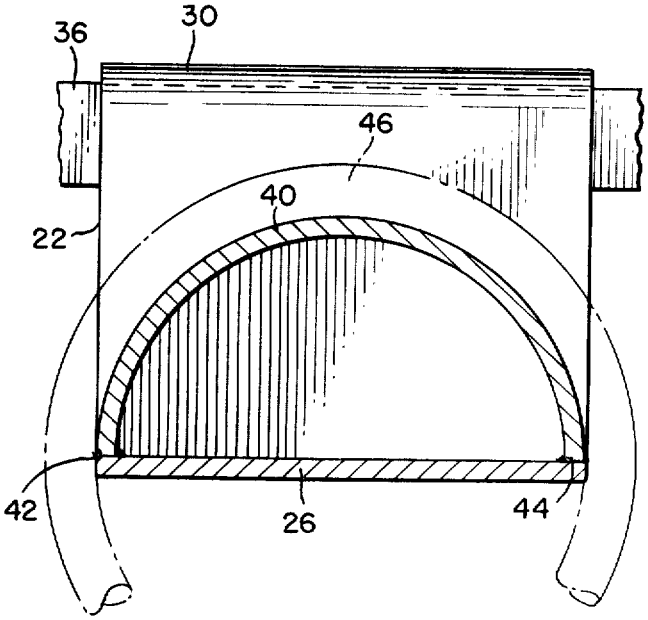
FIG. 3 is a cutaway view of the hanger, softener member and cable taken along the line 3—3 of FIG. 2.
Figure 4:
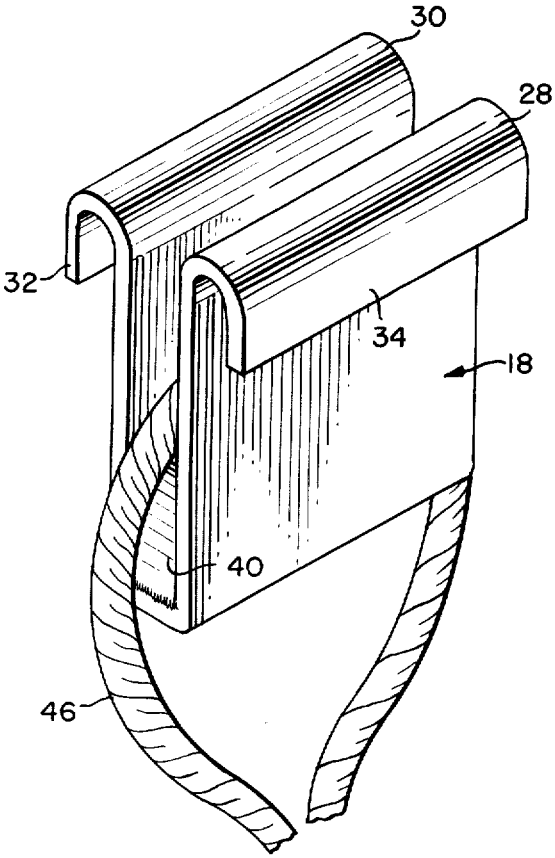
FIG. 4 is a side elevational view of the cable hanger having a looped cable between the parallel side walls.

The hanger 18, FIG. 2, is a single piece of heavy gauge steel or metal and has parallel side walls 22, 24, a connecting bottom wall 26 and U-type bends 28, 30 having downwardly extending walls 32, 34 which are approximately one and one half inches in length in the downward direction. The U-type bends 28, 30 and the downwardly extending walls 32, 34 are shown to overlap grating members 36, 38. A softener device 40 is semi-circular in configuration and is secured at its ends 42, 44 to the bottom wall 26 between the side walls 22, 24 of the hanger.

The softener device 40 is the same width as the spacing between the parallel walls 22, 24 and is adopted to support the loop 46 of cables 20. The ends of the cable are secured in loop fashion by suitable fastening devices 48, FIG. 1. The softener device 40 is provided to prevent cutting or chafing of the looped cable thus preventing damage and possible collapse of the platform 16.

The hangers 18 with U-bends 28, 30 and downwardly extending walls 32, 34 are sufficiently strong and rigid to support heavy loads on the platform 16 by means of the cables 20. The opposite ends 50 of the cables 20 are looped about the ends of platform runners 52 and secured to the cable 20 by suitable cable clamps 54.

The lengths of the downwardly extending walls 32, 34 are critical so that binding against the gratings 36, 38 would occur in the event of overloading of the platform 16. This has proven to be a safety feature where the walls 32, 34 would not spread due to overloading thus preventing collapse of the platform with workers and heavy equipment thereon.

While the invention has been shown and described in detail with reference to a preferred embodiment thereof, it will be understood to those skilled in the art to which this invention pertains that various changes in form and detail may be made therein without departing from the spirit and scope of the invention.

What I claim is:

1. A grating cable hanger comprising:

parallel side walls;

a connecting bottom wall;

U-type oppositely extending bends having depending walls, said U-type bends and defending walls for hanging over a plurality of steel gratings;

a softener member positioned between said parallel side walls;

a cable having a loop at one end, said loop positioned between said parallel side walls and supported on said softener; and a platform for workers and heavy equipment fasten to the opposite ends of said cable.

2. A grating cable hanger as defined in claim 1, wherein:

said parallel side walls, said connecting bottom wall, said U-type bends having said depending walls being of one piece heavy duty metal material.

3. A grating cable hanger as defined in claim 1, wherein:

said parallel side walls being one half inch apart and said cable loop being three eighths of an inch in diameter.

4. A grating cable hanger as defined in claim 1, wherein:

the short end of said cable loop being fastened to the long end of said cable by a plurality of cable clamps.

5. A grating cable hanger as defined in claim 1, wherein:

the opposite ends of said cable being doubly looped about platform end runners and fastened by cable clamps to the cable.

6. A grating cable hanger as defined in claim 1, wherein:

said softener member of semi-circular form, the ends of which being welded to said connecting bottom wall.

7. A grating cable hanger as defined in claim 6, wherein:

said semi-circular softener member being of the same width as said parallel side walls.

8. A grating cable hanger as defined in claim 1, wherein:

said U-type bends extending above said gratings a fraction of an inch to prevent people walking on said grating from tripping.

9. A grating cable hanger as defined in claim 1, wherein:

said depending walls being three eighths inch from said parallel side walls and being one and one half inch in length whereby binding on the gratings would occur upon overloading of the platform.

10. A grating cable hanger as defined in claim 6, and:

said semi-circular softener member for preventing damage or chafing of the cable loop supported thereon.

* * * * *